US010725395B2

(12) United States Patent
Kano et al.

(10) Patent No.: US 10,725,395 B2
(45) Date of Patent: Jul. 28, 2020

(54) CLEANING MEMBER, ASSEMBLY, AND IMAGE FORMING APPARATUS

(71) Applicant: FUJI XEROX CO., LTD., Tokyo (JP)

(72) Inventors: Fuyuki Kano, Kanagawa (JP); Yasuhiko Kinuta, Kanagawa (JP); Akihiro Nonaka, Kanagawa (JP)

(73) Assignee: FUJI XEROX CO., LTD., Tokyo (JP)

( * ) Notice: Subject to any disclaimer, the term of this patent is extended or adjusted under 35 U.S.C. 154(b) by 0 days.

(21) Appl. No.: 16/377,248

(22) Filed: Apr. 7, 2019

(65) Prior Publication Data

US 2020/0096892 A1 Mar. 26, 2020

(30) Foreign Application Priority Data

Sep. 25, 2018 (JP) ..... 2018-179098

(51) Int. Cl.
*G03G 15/02* (2006.01)
*G03G 21/00* (2006.01)

(52) U.S. Cl.
CPC ..... *G03G 15/0225* (2013.01); *G03G 21/0058* (2013.01)

(58) Field of Classification Search
CPC ..... G03G 21/0058
See application file for complete search history.

(56) References Cited

U.S. PATENT DOCUMENTS 8,538,287 B2 9/2013 Kawai
9,372,427 B1 * 6/2016 Kano ..... B32B 7/05

FOREIGN PATENT DOCUMENTS

JP H02-272594 11/1990
JP 2007121545 A * 5/2007
JP 2012-014011 1/2012

OTHER PUBLICATIONS

JP 2007121545_A_T Translation, JP, May 2005, Minoru.*

* cited by examiner

*Primary Examiner* — Victor Verbitsky
(74) *Attorney, Agent, or Firm* — JCIPRNET

(57) ABSTRACT

A cleaning member includes a shaft, and a foamed elastic layer that is disposed on an outer surface of the shaft and in which a relationship between a stress Pw generated by 70% compression deformation and a stress Ps generated by 10% compression deformation satisfies Pw/Ps≥6.

11 Claims, 8 Drawing Sheets

CLEANING MEMBER, ASSEMBLY, AND IMAGE FORMING APPARATUS

CROSS-REFERENCE TO RELATED APPLICATIONS

This application is based on and claims priority under 35 USC 119 from Japanese Patent Application No. 2018-179098 filed Sep. 25, 2018.

BACKGROUND

(i) Technical Field

The present disclosure relates to a cleaning member, an assembly, and an image forming apparatus.

(ii) Related Art

Japanese Unexamined Patent Application Publication No. 2-272594 proposes a method for attaching a roller that is made of a sponge material and used as a cleaning member for a charging roller.

Japanese Unexamined Patent Application Publication No. 2012-14011 proposes an image forming apparatus including a cleaning member that cleans a member to be cleaned, such as a charging roller. The cleaning member includes a core and an elastic layer helically wound around the outer surface of the core. When the outer surface of the elastic layer of the cleaning member comes in contact with the outer surface of the rotating member to be cleaned, the cleaning member is driven to rotate, and the elastic layer of the cleaning member wipes the outer surface of the member to be cleaned.

SUMMARY

Aspects of non-limiting embodiments of the present disclosure relate to a cleaning member including a shaft and a foamed elastic layer disposed on an outer surface of the shaft. The cleaning member has a higher ability to maintain cleaning performance on a member to be cleaned than a cleaning member including a foamed elastic layer in which the relationship between a stress Pw generated by 70% compression deformation and a stress Ps generated by 10% compression deformation satisfies $Pw/Ps<6$.

Aspects of certain non-limiting embodiments of the present disclosure address the above advantages and/or other advantages not described above. However, aspects of the non-limiting embodiments are not required to address the advantages described above, and aspects of the non-limiting embodiments of the present disclosure may not address advantages described above.

According to an aspect of the present disclosure, there is provided a cleaning member including a shaft and a foamed elastic layer that is disposed on an outer surface of the shaft and in which a relationship between a stress Pw generated by 70% compression deformation and a stress Ps generated by 10% compression deformation satisfies $Pw/Ps\geq6$.

BRIEF DESCRIPTION OF THE DRAWINGS

Exemplary embodiments of the present disclosure will be described in detail based on the following figures, wherein.

DETAILED DESCRIPTION

Figure 1:
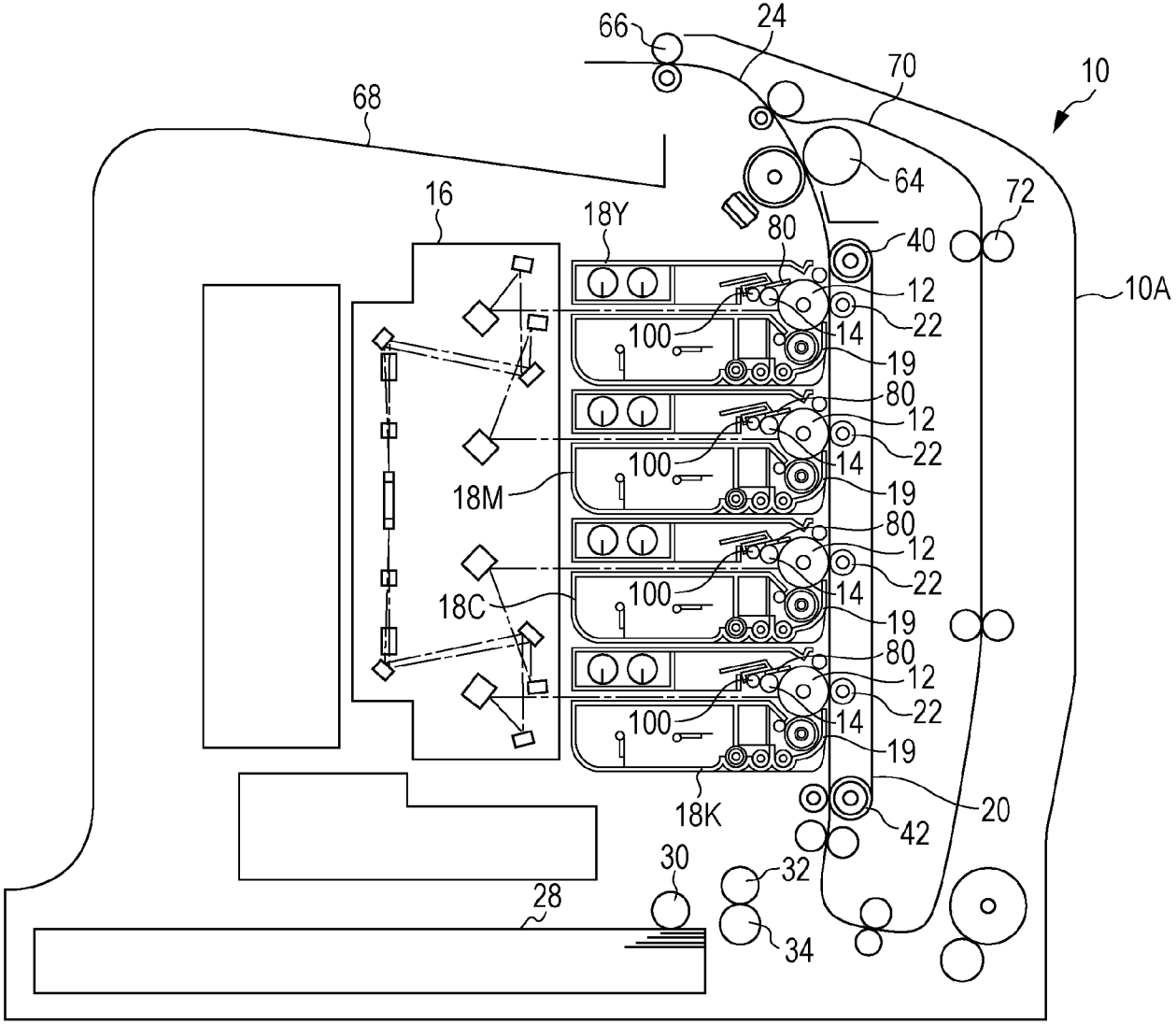
FIG. 1 is a schematic view of an electrographic image forming apparatus according to an exemplary embodiment.

Exemplary embodiments according to the present disclosure will be described below with reference to the drawings. It is noted that components having the same function and the same operation may be provided with the same reference symbol throughout all the drawings, and the description thereof may be omitted.

A cleaning member according to an exemplary embodiment includes a shaft and a foamed elastic layer that is disposed on an outer surface of the shaft and in which a relationship between a stress Pw generated by 70% compression deformation and a stress Ps generated by 10% compression deformation satisfies $Pw/Ps\geq6$.

The cleaning member according to the exemplary embodiment having the above-described feature has a high ability to maintain cleaning performance on a member to be cleaned. The reason for this is assumed as described below.

The phenomenon that occurs in the foamed elastic layer when the foamed elastic layer is deformed in the compression direction is as described below.

As the foamed elastic layer is deformed in the compression direction, the foamed structure is collapsed at the early stage. At this time, the resilience of the foamed structure to return to its original form is generated in the foamed elastic layer.

The resilience of the foamed elastic layer is remarkably exerted when the amount of contact of the foamed elastic layer with the member to be charged is small, specifically, the foamed elastic layer is 10% deformed from its original thickness in the compression direction.

In other words, the stress of the function (sweep effect) of sweeping the surface of the rotating member to be charged in contact with the foamed elastic layer may indicate the stress Ps generated by 10% compression deformation of the foamed elastic layer.

As the foamed elastic layer is continuously deformed in the compression direction, the foamed structure is substantially collapsed to form a solid material (bulk).

At this time, the bulk strength of the material is generated as stress in the foamed elastic layer, and the stress is remarkably exerted when the foamed elastic layer is 70% deformed from its original thickness in the compression direction.

In other words, the stress derived from the strength of the material of the foamed elastic layer that directly acts on the function (wipe function) of mechanically wiping off contaminants attached to the surface of the member to be charged may indicate the stress Pw generated by 70% compression deformation of the foamed elastic layer.

When the relationship between the stress Pw generated by 70% compression deformation of the foamed elastic layer and the stress Ps generated by 10% compression deformation of the foamed elastic layer satisfies $Pw/Ps \geq 6$, the sweep function and the wipe function are both properly exerted as the cleaning performance on the member to be cleaned.

Therefore, the cleaning member according to the exemplary embodiment is supposed to be a cleaning member having a high ability to maintain cleaning performance on the member to be cleaned.

In particular, when the cleaning member according to the exemplary embodiment having the foamed elastic layer deformed at a compression ratio of 15% or more and 30% or less is brought into contact with the member to be cleaned, the cleaning member properly exerts both the sweep function and the wipe function and thus has a high ability to maintain cleaning performance on the member to be cleaned.

The details of exemplary embodiments will be described below with reference to the drawings.

Image Forming Apparatus 10

An image forming apparatus 10 according to an exemplary embodiment will be described. FIG. 1 is a schematic view of the image forming apparatus according to this exemplary embodiment.

The image forming apparatus 10 illustrated in FIG. 1 is an example image forming apparatus that forms an image. Specifically, the image forming apparatus 10 is an electrographic image forming apparatus that forms a toner image (an example image) on a recording medium P. More specifically, the image forming apparatus 10 is a tandem-system image forming apparatus as illustrated in FIG. 1 and has the following structure.

The image forming apparatus 10 has an apparatus body 10A. The apparatus body 10A contains process cartridges 18Y, 18M, 18C, and 18K (hereinafter collectively referred to as 18), which correspond to yellow (Y), magenta (M), cyan (C), and black (K).

Figure 2:
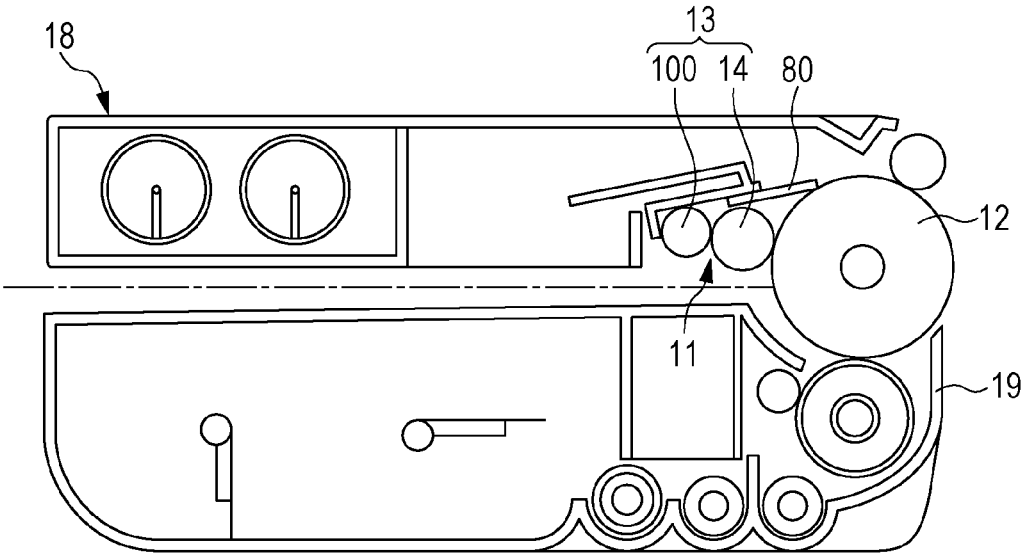
FIG. 2 is a schematic view of a process cartridge according to an exemplary embodiment.

As illustrated in FIG. 2, each process cartridge 18 includes a photoreceptor 12 (an example image carrier, an example member to be charged), which can carry an image, a charging device 11, which has a charging member 14 (an example charging member), and a developing device 19. Each process cartridge 18 is attachable to and detachable from the apparatus body 10A illustrated in FIG. 1 and functions as an example assembly formed so as to be integrally attachable to and detachable from the apparatus body 10A. Each assembly according to the exemplary embodiment includes at least the photoreceptor 12 and the charging device 11. The detailed structure of the charging device 11 in the process cartridge 18 will be described below.

The surface of the photoreceptor 12 illustrated in FIG. 1 is charged by the charging member 14 and then subjected to image exposure with a laser beam emitted from an exposure device 16 to form an electrostatic latent image corresponding to image information. The electrostatic latent image formed on the photoreceptor 12 is developed by the developing device 19 to form a toner image.

For example, in the case of forming a color image, the surfaces of the photoreceptors 12 for respective colors are subjected to the charging, exposing, and developing steps corresponding to yellow (Y), magenta (M), cyan (C), and black (K) colors to form toner images corresponding to yellow (Y), magenta (M), cyan (C), and black (K) colors on the surfaces of the photoreceptors 12 for respective colors.

The toner images corresponding to yellow (Y), magenta (M), cyan (C), and black (K) colors sequentially formed on the photoreceptors 12 are transferred onto a recording medium 24, which is transported through a transport belt 20 supported by supporting rollers 40 and 42, at positions at which the photoreceptors 12 oppose the corresponding transfer devices 22 across the transport belt 20. The recording medium 24 onto which the toner images have been transferred from the photoreceptors 12 is further transported to a fixing device 64. The toner images are heated and pressed by the fixing device 64 and thus fixed to the recording medium 24. In the case of single-sided printing, the recording medium 24 to which the toner images have been fixed is subsequently discharged onto a discharge section 68 in the upper part of the image forming apparatus 10 by a discharge roller 66.

The recording medium 24 is drawn from a storage container 28 by a drawing roller 30 and transported to the transport belt 20 by transport rollers 32 and 34.

In the case of double-sided printing, the recording medium 24 having a first surface (front surface) to which the toner images have been fixed by the fixing device 64 is not discharged onto the discharge section 68 by the discharge roller 66, and the discharge roller 66 is reversely rotated while the trailing edge of the recording medium 24 is supported by the discharge roller 66. Accordingly, the recording medium 24 is introduced to a transport path 70 for double-sided printing, and the recording medium 24 is transported onto the transport belt 20 again by a transport roller 72, which is disposed in the transport path 70 for double-sided printing, while the front and back surfaces of the recording medium 24 are reversed. The toner images are then transferred to a second surface (back surface) of the recording medium 24 from the photoreceptors 12. Subsequently, the toner images on the second surface (back surface) of the recording medium 24 are fixed by the fixing device 64, and the recording medium 24 (transfer receptor) is discharged onto the discharge section 68.

Residual toners, paper powder, and the like on the surfaces of the photoreceptors 12 after completion of the step of transferring the toner images are removed by cleaning blades 80 after each rotation of the photoreceptors 12. The cleaning blades 80 are disposed on the surfaces of the photoreceptors 12 and downstream of the positions at which the photoreceptors 12 oppose the corresponding transfer devices 22 in the rotation direction of the photoreceptors 12. This configuration allows the photoreceptors 12 to be ready for the subsequent image forming step.

The image forming apparatus 10 according to the exemplary embodiment is not limited to the above-described structure and may be a well-known image forming apparatus, such as an intermediate transfer-type image forming apparatus.

Charging Device 11

Figure 3:
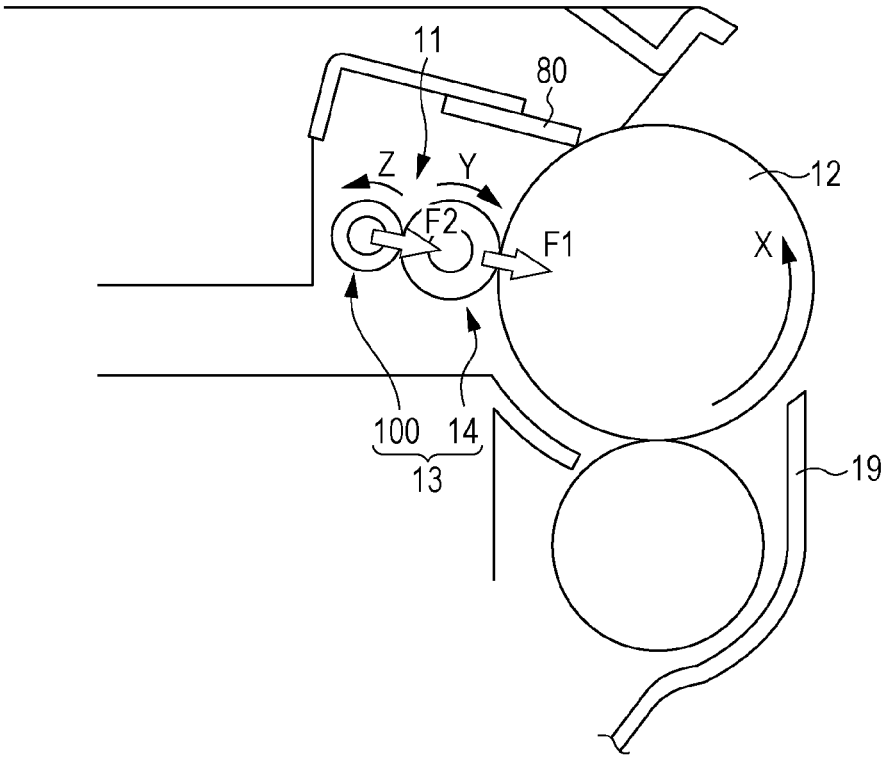
FIG. 3 is an enlarged schematic view of a charging member (charging device) and the surrounding area in FIG. 1 and FIG. 2.

As illustrated in FIG. 3, the charging device 11 (charging unit) includes a cleaning device 13. The cleaning device 13 includes the charging member 14 (an example charging member, an example member to be cleaned), which charges the photoreceptor 12, and a cleaning member 100, which cleans the charging member 14. The detailed structures of the charging member 14 and the cleaning member 100 will be described below.

Charging Member 14

Figure 4:
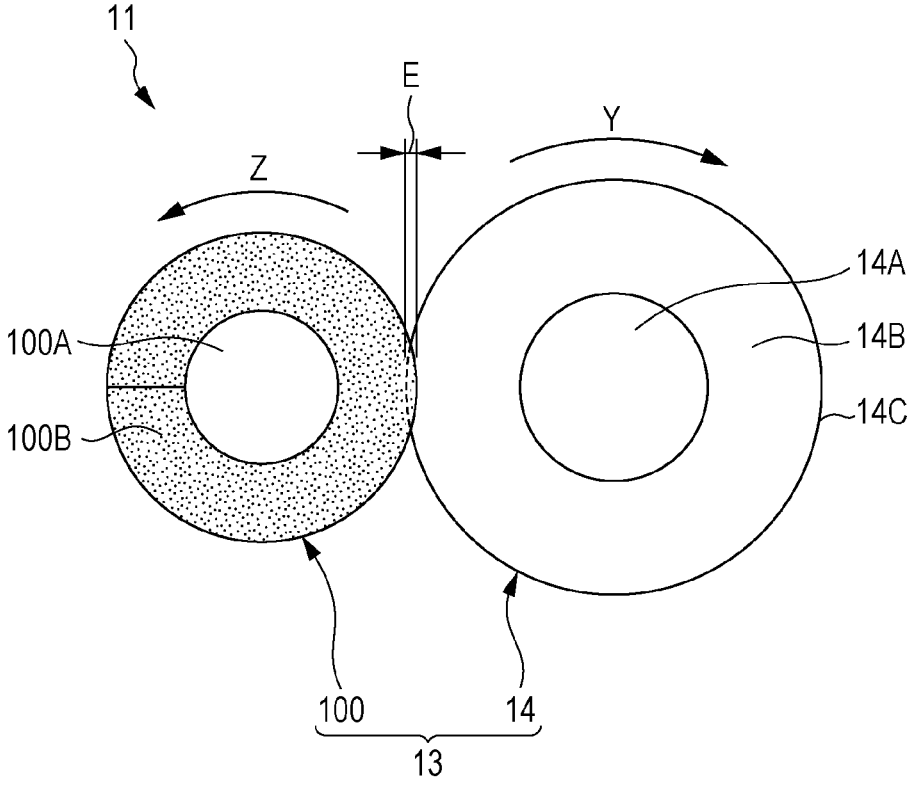
FIG. 4 is a schematic side view of the charging device according to the exemplary embodiment.

The charging member 14 illustrated in FIG. 3 is an example member to be cleaned. The member to be cleaned has an uneven surface. The charging member 14 is also an example charging member that charges the member to be charged. Specifically, the charging member 14 is a charging roller that charges the photoreceptor 12. More specifically, the charging member 14 includes a core 14A and an elastic layer 14B, as illustrated in FIG. 4.

Core 14A

Specifically, the core 14A is a shaft formed of a conductive hollow cylindrical member or a conductive cylindrical member. The core 14A is made of, for example, free-cutting steel or stainless steel. The surface treatment method and the like are appropriately selected according to the required functionality, such as sliding properties. When the core 14A is made of a non-conductive material, the core 14A may be processed to have conductivity by an ordinary electrical conduction treatment, such as a plating treatment.

Elastic Layer 14B

The elastic layer 14B is, specifically, a conductive foamed elastic layer. The elastic layer 14B is disposed on the outer surface of the core 14A and is formed in a hollow cylindrical shape.

The elastic layer 14B may be made of a material obtained by adding, for example, to an elastic material having elasticity such as rubber, a conductive agent intended to adjust resistance, and as necessary, materials that may be added to ordinary rubber, such as a softener, a plasticizer, a hardener, a vulcanizing agent, a vulcanization accelerator, an anti-aging agent, and a filler such as silica or calcium carbonate.

The conductive agent intended to adjust the resistance value may be, for example, a material that conducts electricity through charge carriers, such as at least either electrons or ions. The conductive agent may be, for example, carbon black or an ion conductive agent to be added to a matrix material.

The elastic material that forms the elastic layer 14B is produced by, for example, dispersing a conductive agent in a rubber material. Examples of the rubber material include a silicone rubber, an ethylene propylene rubber, an epichlorohydrin-ethylene oxide copolymer rubber, an epichlorohydrin-ethylene oxide-allyl glycidyl ether copolymer rubber, an acrylonitrile-butadiene copolymer rubber, and blended rubbers thereof. These rubber materials may be foamed or non-foamed.

An electroconductive agent and an ion conductive agent are used as a conductive agent. Examples of the electroconductive agent include fine powders formed of carbon black, such as Ketjenblack and acetylene black; fine powders formed of pyrolytic carbon or graphite; fine powders formed of various conductive metals or alloys, such as aluminum, copper, nickel, and stainless steel; fine powders formed of various conductive metal oxides, such as tin oxide, indium oxide, titanium oxide, tin oxide-antimony oxide solid solution, and tin oxide-indium oxide solid solution; and fine powders formed of materials obtained by processing the surfaces of insulating materials so as to have conductivity.

Examples of the ion conductive agent include perchlorates and chlorates of oniums, such as tetraethylammonium and lauryltrimethylammonium; perchlorates and chlorates of alkali metals and alkaline earth metals, such as lithium and magnesium. These conductive agents may be used alone or in combination of two or more.

The amount of the conductive agent added is not limited. The amount of the electroconductive agent added may be in the range of 1 part by mass or more and 60 parts by mass or less relative to 100 parts by mass of the rubber material. The amount of the ion conductive agent added may be in the range of 0.1 parts by mass or more and 5.0 parts by mass or less relative to 100 parts by mass of the rubber material. When the resistance value is controlled with such a conductive agent, the resistance value of the elastic layer 14B does not change depending on the environmental conditions, which may result in stable properties.

The charging member 14 may have a surface layer 14C in its surface. The surface layer 14C may be made of any polymer material, such as resin (polymer material) or rubber.

Examples of the polymer material in the surface layer 14C include polyvinylidene fluoride, tetrafluoroethylene copolymers, polyester, polyimide, and copolymer nylon. Examples of the polymer material in the surface layer 14C include fluorocarbon-based resins and silicone-based resins. The polymer material may be used alone or in combination of two or more.

The resistance value may be adjusted by adding a conductive material to the surface layer 14C. Examples of the conductive material intended to adjust the resistance value include carbon black, conductive metal oxide particles, and an ion conductive agent. The conductive material may be used alone or in combination of two or more.

The surface layer 14C may contain insulating particles made of, for example, alumina or silica.

Configuration for Supporting Charging Member 14

In the charging member 14 illustrated in FIG. 3, the opposite ends of the core 14A in the axial direction are rotatably supported by support parts (not illustrated), such as bearings. The charging member 14 is pressed against the photoreceptor 12 by applying a load F1 to the opposite ends of the core 14A in the axial direction via the support parts. Accordingly, the elastic layer 14B is elastically deformed along the surface (outer surface) of the photoreceptor 12 to form a contact region having a specific width between the charging member 14 and the photoreceptor 12.

As the photoreceptor 12 is driven to rotate in the direction of arrow X by a motor (not illustrated), the charging member 14 rotates in the direction of arrow Y by following the rotation of the photoreceptor 12. In other words, the charging member 14 is driven to rotate in such a manner that the axial direction of the core 14A corresponds to the direction of the rotation axis. Therefore, the axial direction of the charging member 14 and the axial direction of the core 14A correspond to the direction of the rotation axis of the charging member 14. It is noted that the cleaning member 100 is driven to rotate in the direction of arrow Z as the charging member 14 rotates.

Cleaning Member 100

Figure 5:
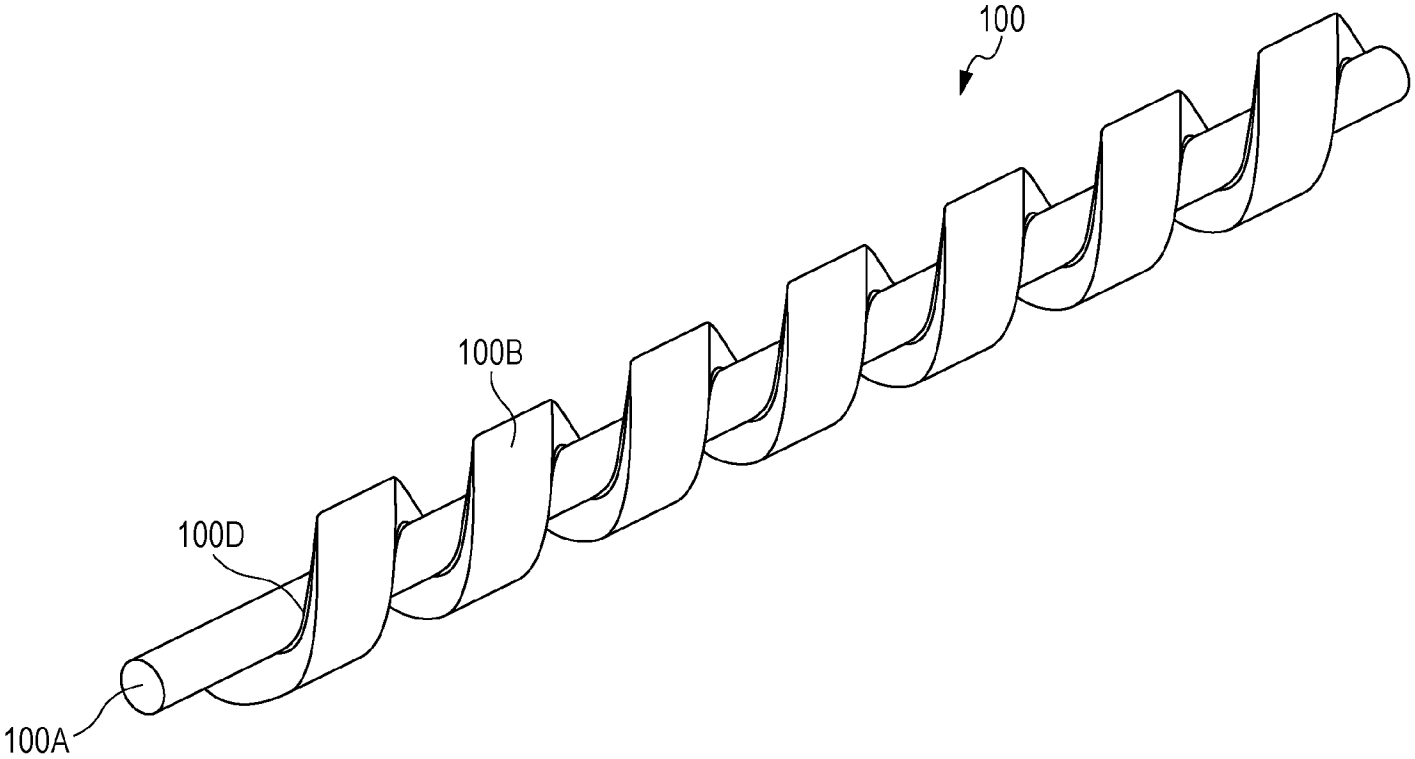
FIG. 5 is a schematic perspective view of a cleaning member according to an exemplary embodiment.
Figure 6:
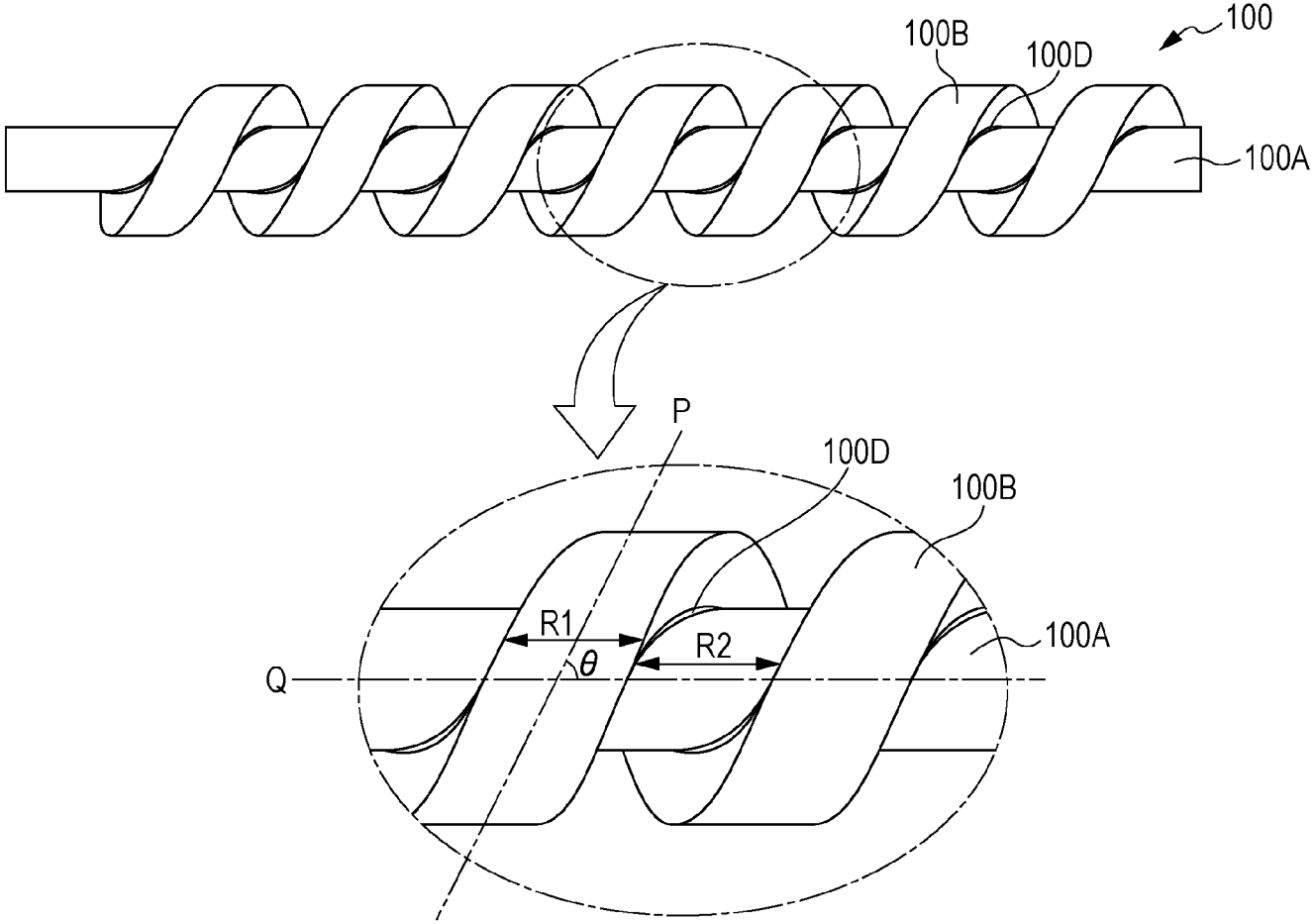
FIG. 6 is a schematic plan view of the cleaning member according to the exemplary embodiment.

FIG. 5 is a schematic perspective view of a cleaning member according to an exemplary embodiment. FIG. 6 is a schematic plan view of the cleaning member according to the exemplary embodiment.

The cleaning member 100 (an example cleaning member) illustrated in FIG. 5 and FIG. 6 includes a core 100A (an example shaft) and a foamed elastic layer 100B, which is disposed on the outer surface of the core 100A and comes in contact with the charging member 14.

The cleaning member 100 includes an adhesive layer 100D in addition to the core 100A and the foamed elastic layer 100B. The adhesive layer 100D is used to attach the core 100A to the foamed elastic layer 100B. The cleaning member 100 is a roll-shaped member.

Core 100A

Examples of the material used for the core 100A include metals (e.g., free-cutting steel or stainless steel) and resins (e.g., polyacetal resin (POM)). The material, the surface treatment method, and the like are selected as necessary.

In particular, when the core 100A is made of metal, the core 100A may undergo a plating treatment. When the core 100A is made of a non-conductive material, such as resin, the core 100A may be processed to have electrical conductivity by an ordinary treatment such as a plating treatment or may be used without any treatment.

Adhesive Layer 100D

The adhesive layer 100D may be made of any material that may bond the core 100A to the foamed elastic layer 100B, and may be formed of, for example, a double-sided tape or other adhesive.

Foamed Elastic Layer 100B

The foamed elastic layer 100B is a foamed material (i.e., foam). Specific materials of the foamed elastic layer 100B will be described below.

Figure 8:
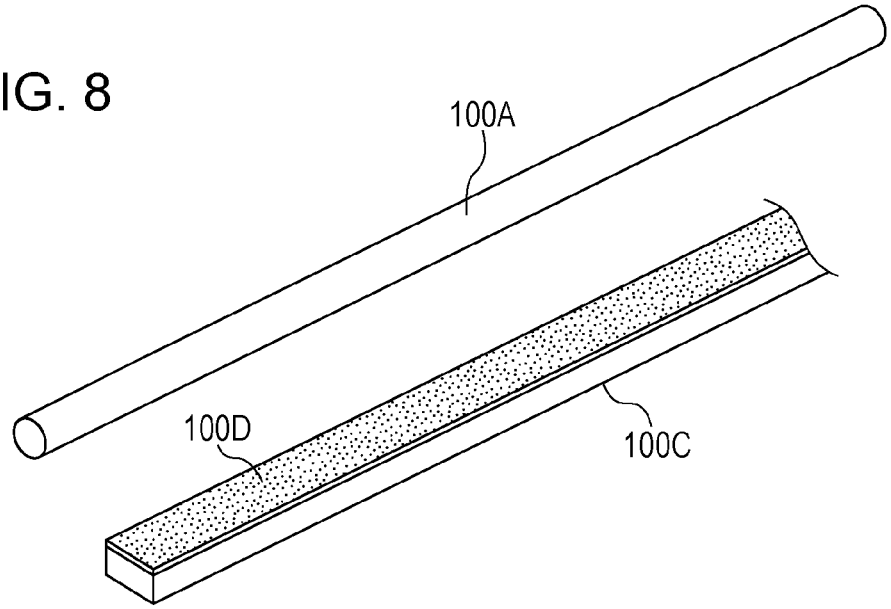
FIG. 8 is a process diagram illustrating a step of an exemplary method for producing the cleaning member according to an exemplary embodiment.
Figure 9:
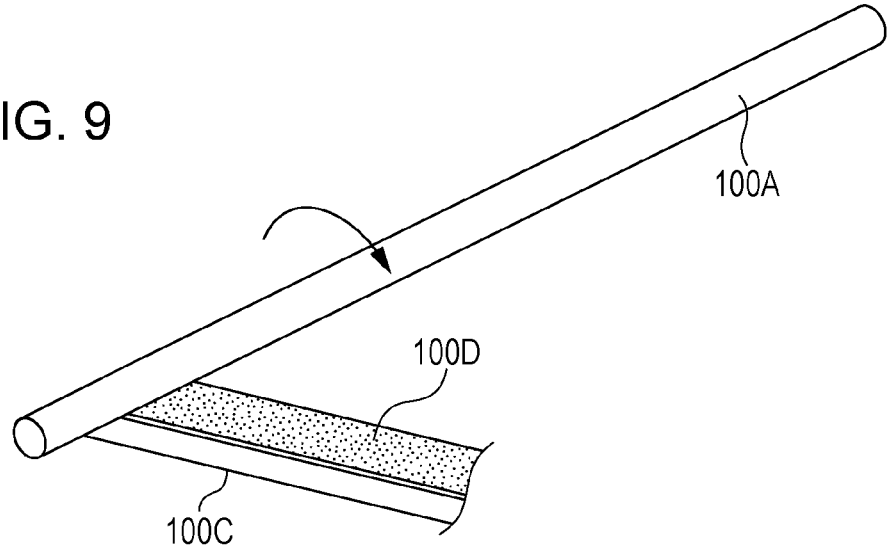
FIG. 9 is a process diagram illustrating a step of the exemplary method for producing the cleaning member according to the exemplary embodiment.
Figure 10:
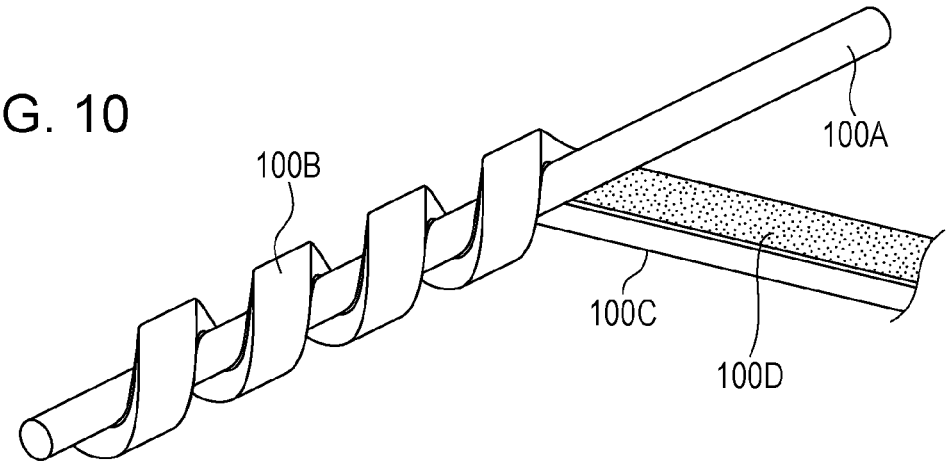
FIG. 10 is a process diagram illustrating a step of the exemplary method for producing the cleaning member according to the exemplary embodiment.

As illustrated in FIG. 5 and FIG. 6, the foamed elastic layer 100B is helically disposed on the outer surface of the core 100A from one end side of the core 100A in the axial direction to the other end side in the axial direction. Specifically, as illustrated in FIG. 8 to FIG. 10, the foamed elastic layer 100B is formed by, for example, helically winding a strip-shaped foamed elastic member 100C (may be hereinafter referred to as a strip 100C) at a predetermined helix pitch around the core 100A, which serves as a helix axis, from one end of the core 100A in the axial direction to the other end in the axial direction.

Figure 7:
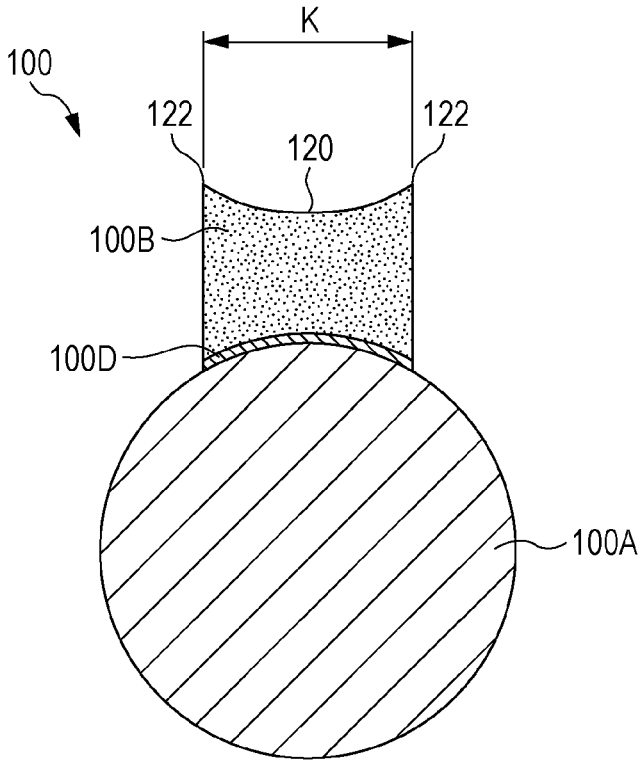
FIG. 7 is a schematic sectional view of the cleaning member according to the exemplary embodiment as viewed in the axial direction.

As illustrated in FIG. 7, the foamed elastic layer 100B has a quadrangular shape enclosed by four sides (including curves) in the cross-section as viewed in the axial direction of the core 100A. The opposite edges of the foamed elastic layer 100B in the width direction (K direction) have projections 122 that project outward beyond a central portion 120 in the radial direction of the core 100A. The projections 122 are formed in the longitudinal direction of the foamed elastic layer 100B.

The projections 122 are formed by, for example, applying tension to the foamed elastic layer 100B in the longitudinal direction to produce a difference in outer diameter between the central portion 120 of the outer surface of the foamed elastic layer 100B in the width direction and the opposite edges in the width direction.

The thickness (the thickness of the central portion in the width direction) of the foamed elastic layer 100B is, for example, 1.0 mm or more and 3.0 mm or less, preferably 1.4 mm or more and 2.6 mm or less, and more preferably 1.6 mm or more and 2.4 mm or less.

The thickness of the foamed elastic layer 100B is determined, for example, in the following manner.

With the circumferential direction of the cleaning member fixed, the profile of the thickness of the foamed elastic layer (the layer thickness of the foamed elastic layer) is measured by scanning the cleaning member in the longitudinal direction (axial direction) with a laser measuring device (laser scan micrometer available from Mitutoyo Corporation) at a traverse speed of 1 mm/s. The same measurement is then performed at different points in the circumferential direction (at three points 120° apart in the circumferential direction). The thickness of the foamed elastic layer 100B is calculated on the basis of this profile.

The foamed elastic layer 100B is helically disposed. Specifically, for example, the helix angle θ may be 10° or more and 65° or less (preferably 15° or more and 50° or less). The helix width R1 may be 3 mm or more and 25 mm or less (preferably 3 mm or more and 10 mm or less). The helix pitch R2 may be, for example, 3 mm or more and 25 mm or less (preferably 15 mm or more and 22 mm or less) (see FIG. 6).

The coverage of the foamed elastic layer 100B (the helix width R1 of the foamed elastic layer 100B/[the helix width R1 of the foamed elastic layer 100B+the helix pitch R2 of the foamed elastic layer 100B: (R1+R2)]) may be 20% or more and 70% or less, and preferably 25% or more and 55% or less.

When the coverage is larger than the above-described range, the time during which the foamed elastic layer 100B is in contact with the member to be cleaned is long and, therefore, adhering matter on the surface of the cleaning member tends to recontaminate the member to be cleaned. When the coverage is smaller than the above-described range, it is difficult to stabilize the thickness (layer thickness) of the foamed elastic layer 100B, and the cleaning ability tends to deteriorate.

The helix angle θ refers to an angle (acute angle) at which the longitudinal direction P (helix direction) of the foamed elastic layer 100B and the axial direction Q (core axial direction) of the core 100A intersect (see FIG. 6).

The helix width R1 refers to the dimension of the foamed elastic layer 100B in the axial direction Q (core axial direction) of the cleaning member 100.

The helix pitch R2 refers to the distance between adjacent portions of the foamed elastic layer 100B in the axial direction Q (core axial direction) of the cleaning member 100 having the foamed elastic layer 100B.

The foamed elastic layer 100B refers to a layer made of a material that, even when deformed by application of an external force of 100 Pa, returns to its original shape.

Material of Foamed Elastic Layer 100B

Examples of the material of the foamed elastic layer 100B include materials obtained by blending one or two or more materials selected from foamed resins (e.g., polyurethanes, polyethylenes, polyamides, and polypropylenes) and rubber materials (e.g., silicone rubber, fluorocarbon rubber, urethane rubber, ethylene-propylene-diene rubber (EPDM), acrylonitrile-butadiene copolymer rubber (NBR), chloroprene rubber (CR), chlorinated polyisoprene, isoprene, acrylonitrile-butadiene rubber, styrene-butadiene rubber, hydrogenated polybutadiene, and butyl rubber).

To these materials, an auxiliary, such as a foaming auxiliary, a foam stabilizer, a catalyst, a curing agent, a plasticizer, or a vulcanization accelerator, may be added as necessary.

The foamed elastic layer 100B may be made of foamed polyurethane having high tensile strength in order not to scratch, particularly by friction, the surface of the member to be cleaned (charging member 14) or to prevent the foamed elastic layer 100B from being torn or damaged for a long period of time.

Examples of polyurethane include reaction products between polyols (e.g., polyester polyols, polyether polyols, polyesters, and acrylic polyols) and isocyanates (e.g., 2,4-tolylene diisocyanate, 2,6-tolylene diisocyanate, 4,4-diphenylmethane diisocyanate, tolylene diisocyanate, and 1,6-hexamethylene diisocyanate). Polyurethane may include a chain extender (1,4-butanediol or trimethylolpropane).

Polyurethane is typically foamed by using a foaming agent, such as water or an azo compound (e.g., azodicarbonamide or azobisisobutyronitrile).

To the foamed polyurethane, an auxiliary, such as a foaming auxiliary, a foam stabilizer, or a catalyst, may be added as necessary.

Among these foamed polyurethanes, ether-based foamed polyurethane may be used. This is because ester-based foamed polyurethane tends to be degraded by heat and moisture. A foam stabilizer composed of silicone oil is typically used for ether-based polyurethane. However, an image quality defect may occur as a result of the transfer of silicone oil to the member to be cleaned (charging member 14) during storage (particularly long-term storage under high temperature and high humidity). Therefore, the use of a foam stabilizer other than silicone oil may prevent or reduce generation of an image quality defect otherwise caused by the foamed elastic layer 100B.

Specific examples of the foam stabilizer other than silicone oil include Si-free organic surfactants (e.g., anionic surfactants, such as dodecylbenzenesulfonic acid and sodium lauryl sulfate). A production method without using a silicone-based foam stabilizer may be used.

Whether a foam stabilizer other than silicone oil has been used for ester-based foamed polyurethane is determined on the basis of whether Si is present or absent according to composition analysis.

Stress Generated by Compression Deformation of Foamed Elastic Layer 100B

In the foamed elastic layer 100B, the relationship between the stress Pw generated by 70% compression deformation and the stress Ps generated by 10% compression deformation satisfies $Pw/Ps \geq 6$.

To properly exert both the sweep function and the wipe function and improve the ability to maintain cleaning performance, $Pw/Ps \geq 7$ is preferably satisfied. The expression "stress generated by X % compression deformation" may also be hereinafter referred to as "X % compression stress".

To properly exert both the sweep function and the wipe function and improve the ability to maintain cleaning performance, for example, an increase in stress from the 50% compression stress to the 80% compression stress in the foamed elastic layer 100B may be larger than an increase in stress from the 10% compression stress Ps to the 50% compression stress $P_{50}$.

Specifically, for example, the relationship between the 50% compression stress $P_{50}$ and the 10% compression stress Ps preferably satisfies $2.6 \geq P_{50}/Ps \geq 2.3$.

The relationship between the 80% compression stress $P_{80}$ and the 10% compression stress Ps preferably satisfies $P_{80}/Ps \geq 12$, and more preferably satisfies $P_{80}/Ps \geq 14$. The upper limit of $P_{80}/Ps$ may be, for example, 20 or less.

The X % compression stress can be controlled by adjusting, for example, type of material, foam structure, and density.

The X % compression stress (unit: N/mm) is a value measured in the following manner.

A test piece is taken from the foamed elastic layer 100B.

The test piece has a thickness equal to the thickness of the foamed elastic layer 100B (the thickness of the foamed elastic layer 100B removed from the core 100A) targeted for measurement and has a size of 5 mm×5 mm square.

Next, the test piece is fixed on the measurement table in a load tester (MODEL-1605N (available from Aikoh Engineering Co., Ltd.)) in such a manner that the surface of 5 mm×5 mm square becomes horizontal. A measurement terminal with an end having a size of 5 mm×5 mm square is then attached to the load tester.

Next, the load cell is moved in the thickness direction (compression direction) of the test piece under a condition of a loading rate of 1 mm/min, and the distortion amount (compression deformation amount) and the stress (specifically compression strength) during compression are measured.

From the measurement, the stress generated by X % compression deformation of the foamed elastic layer 100B is determined.

The percentage X % of the X % compression deformation is calculated from [(the thickness of the original sample−the thickness of the sample during compression deformation)/the thickness of the original sample]×100.

Configuration for Supporting Cleaning Member 100

As illustrated in FIG. 3, the foamed elastic layer 100B of the cleaning member 100 is in contact with the surface of the charging member 14 opposite to the photoreceptor 12. Specifically, the foamed elastic layer 100B of the cleaning member 100 is pressed against the charging member 14 by pressing the opposite ends of the core 100A in the axial direction toward the charging member 14 under a load F2. As a result, the foamed elastic layer 100B elastically deforms along the circumferential surface of the charging member 14 to form a contact region.

The cleaning member 100 may be in contact with the charging member 14 while the foamed elastic layer 100B is deformed at a compression ratio of 15% or more and 30% or less (more preferably 20% or more and 25% or less).

If the compression ratio of the foamed elastic layer 100B is less than 15%, the cleaning member 100 is unlikely to exert a good wipe function and tends to have a low ability to maintain cleaning maintenance.

If the compression ratio of the foamed elastic layer 100B is more than 30%, the wipe function is strongly exerted to cause the phenomenon in which contaminants are strongly rubbed against the cleaning member 14. As a result, the ability to maintain cleaning performance tends to be deteriorated.

The compression ratio of the foamed elastic layer 100B is calculated from [(the thickness of the original foamed elastic layer 100B−the thickness of the foamed elastic layer 100B in a region in contact with the charging member 14 (i.e., the member to be cleaned)/the thickness of the original foamed elastic layer 100B]×100.

The thickness of the foamed elastic layer 100B refers to the thickness of a central portion of the foamed elastic layer 100B in the width direction disposed on the core 100A.

The amount E of nipping between the charging member 14 and the cleaning member 100 (see FIG. 4) is more than 0 mm and 0.3 mm or less. The amount of nipping is obtained from a difference between the center distance between the charging member 14 and the cleaning member 100 and a value obtained by adding the radius of the cleaning member 100 in an unloaded state to the radius of the charging member 14 in an unloaded state. If the amount of nipping varies in the axial direction of the cleaning member 100, the minimum amount of nipping is taken as the amount of nipping.

The cleaning member 100 is driven to rotate in the direction of arrow Z as the charging member 14 rotates. The cleaning member 100 is not necessarily always in contact with the charging member 14, and may be driven to rotate by contact with the charging member 14 only during cleaning of the charging member 14. Alternatively, the cleaning member 100 may be brought into contact with the charging member 14 only during cleaning of the charging member and rotated by separately driving the cleaning member 100 and the charging member 14 with a circumferential speed difference.

Method for Producing Cleaning Member 100

Next, a method for producing the cleaning member 100 according to an exemplary embodiment will be described. FIGS. 8 to 10 are process diagrams illustrating an exemplary method for producing the cleaning member 100 according to an exemplary embodiment.

First, as illustrated in FIG. 8, a sheet-shaped foamed elastic member (e.g., foamed polyurethane sheet) that has been sliced so as to have an intended thickness is prepared. The foamed elastic member is then punched with a punch die to provide a sheet having an intended width and an intended length.

A double-sided tape 100D is then stuck to one surface of the sheet-shaped foamed elastic member to provide a strip 100C (a strip-shaped foamed elastic member with the double-sided tape 100D) having an intended width and an intended length.

Next, as illustrated in FIG. 9, the strip 100C is placed with the surface with the double-sided tape 100D upward. In this state, an end portion of the release liner of the double-sided tape 100D is released, and an end portion of the core 100A is placed on the portion of the double-sided tape from which the release liner has been released.

Next, as illustrated in FIG. 10, the strip 100C is helically wound around the outer surface of the core 100A by rotating the core 100A at an intended speed while the release liner of the double-sided tape is being released. This provides the cleaning member 100 having the foamed elastic layer 100B helically disposed around the outer surface of the core 100A.

When the strip 100C, which serves as the foamed elastic layer 100B, is wound around the core 100A, the strip 100C may be positioned in such a manner that the longitudinal direction of the strip 100C and the axial direction of the core 100A form an intended angle (helix angle). The outer diameter of the core 100A may be, for example, 3 mm or more and 6 mm or less.

The tension applied when the strip 100C is wound around the core 100A may be such that no gap is formed between the core 100A and the double-sided tape 100D of the strip 100C. The tension may not be too high. This is because the application of excessive tension tends to result in large tensile permanent elongation and tends to lower the elastic force of the foamed elastic layer 100B required for cleaning. Specifically, for example, the tension applied when the strip 100C is wound around the core 100A may be such that the strip 100C elongates by more than 0% and 5% or less of its original length.

When the strip 100C is wound around the core 100A, the strip 100C tends to elongate. This elongation tends to vary in the thickness direction of the strip 100C. The outer edge of the strip 100C tends to elongate most, which may lower its elastic force. Therefore, the elongation of the outer edge after the strip 100C is wound around the core 100A may be set to about 5% of the outer edge of the original strip 100C.

This elongation is controlled by the radius of curvature at which the strip 100C is wound around the core 100A and the thickness of the strip 100C. The radius of curvature at which the strip 100C is wound around the core 100A is controlled by the outer diameter of the core 100A and the winding angle (helix angle θ) of the strip 100C.

The radius of curvature at which the strip 100C is wound around the core 100A may be, for example, ((core outer diameter/2)+0.2 mm) or more and ((core outer diameter/2)+8.5 mm) or less, and preferably ((core outer diameter/2)+0.5 mm) or more and ((core outer diameter/2)+7.0 mm) or less.

The thickness of the strip 100C is, for example, 1.5 mm or more and 4 mm or less, and preferably 1.5 mm or more and 3.0 mm or less. The width of the strip 100C may be adjusted in such a manner that the coverage of the foamed elastic layer 100B is in the above-described range. The length of the strip 100C is determined by, for example, the axial length of a region of the strip 100C to be wound around the core 100A, the winding angle (helix angle θ), and the winding tension.

Operation of Exemplary Embodiments

The operation of the exemplary embodiments will be next described.

In the exemplary embodiments, foreign matter, such as developer, that is not transferred to the recording medium 24 and remains on the photoreceptor 12 is removed from the photoreceptor 12 by the cleaning blade 80. Part of foreign matter, such as developer, that is not removed by the cleaning blade 80 and passes through the cleaning blade 80 adheres to the surface of the charging member 14 (see FIG. 1).

The foreign matter adhering to the surface of the charging member 14 is removed in such a manner that the projections 122 and the outer surface (upper surface in FIG. 7) of the foamed elastic layer 100B come into contact with the charging member 14 and wipe the outer surface of the charging member 14.

Modification

The foamed elastic layer 100B is not necessarily formed of one strip 100C. For example, as illustrated in FIG. 11 and FIG. 12, the foamed elastic layer 100B may be formed of at least two or more strips 100C (strip-shaped foamed elastic members), and these two or more strips 100C may be helically wound around the core 100A.

Figure 11:
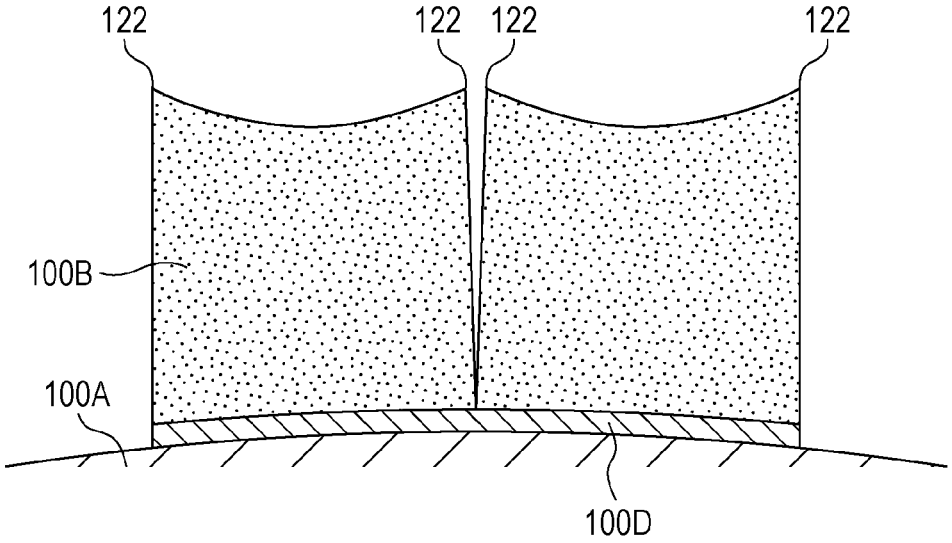
FIG. 11 is an enlarged sectional view of a foamed elastic layer in a cleaning member according to another exemplary embodiment.
Figure 12:
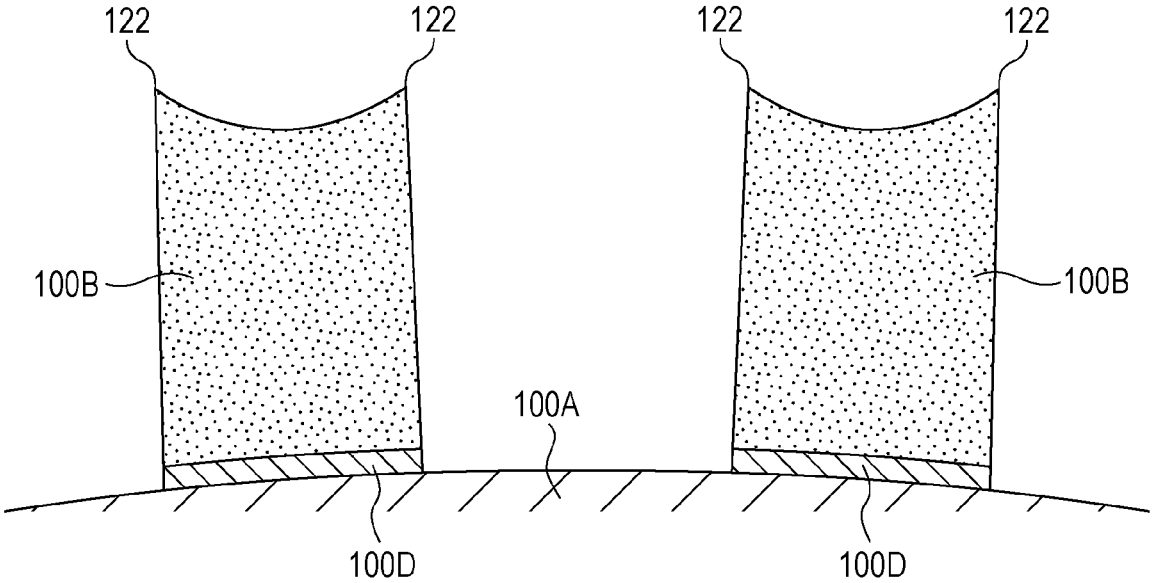
FIG. 12 is an enlarged sectional view of a foamed elastic layer in a cleaning member according to another exemplary embodiment.

The foamed elastic layer 100B having two or more strips 100C (strip-shaped foamed elastic members) helically wound around the core 100A may be such that the edges of the adhesive surface of the strip 100C (the surface of the strip 100C that opposes the outer surface of the core 100A) in the longitudinal direction are in contact with each other (see FIG. 11). Alternatively, the foamed elastic layer 100B may be helically wound in such a manner that the edges of the adhesive surface of the strip 100C in the longitudinal direction are out of contact with each other (see FIG. 12).

Other Modification

In the foregoing description, the image forming apparatus 10 according to the exemplary embodiment includes, as the charging device 11, a unit having the charging member 14 and the cleaning member 100, that is, includes the charging member 14 as a member to be cleaned. However, the image forming apparatus 10 according to the exemplary embodiment is not limited to this structure. Examples of the member to be cleaned include a photoreceptor (image carrier), a transfer device (transfer member; transfer roller), and an intermediate transfer member (intermediate transfer belt). The unit having the member to be cleaned and the cleaning member disposed in contact with the member to be cleaned may be disposed directly in the image forming apparatus or may be disposed as a cartridge like a process cartridge in the image forming apparatus in the same manner as that described above.

The present disclosure is not limited to the above-described exemplary embodiments, and various changes, modifications, and improvements can be made without departing from the spirit of the present disclosure. For example, an exemplary embodiment of the present disclosure may be formed by appropriately combining the modifications described above.

EXAMPLES

The present disclosure will be described below in more detail by way of Examples. However, the present disclosure is not limited by these Examples.

Charging Roller

Formation of Elastic Layer

The following mixture is kneaded with an open roller. The kneaded mixture is placed in a hollow cylindrical shape around the outer surface of a conductive core 14A so as to have a thickness of 1.5 mm. The conductive core 14A is made of SUS416 and has a diameter of 9 mm and a length 354.5 mm. The obtained product is placed in a hollow cylindrical mold having an inner diameter of 12.0 mm and vulcanized at 170° C. for 30 minutes. The volcanized material is taken out of the mold and then polished. This process provides a hollow cylindrical conductive elastic layer 14B.

| | |
|---|---|
| Rubber material (epichlorohydrin-ethylene oxide-allyl glycidyl ether copolymer rubber, Gechron 3106 available from Zeon Corporation) | 100 parts by mass |
| Conductive agent (carbon black, Asahi Thermal available from Asahi Carbon Co., Ltd.) | 25 parts by mass |
| Conductive agent (Ketjenblack EC available from LION Corporation) | 8 parts by mass |
| Ion conductive agent (lithium perchlorate) | 1 part by mass |
| Vulcanizing agent (sulfur, 200 mesh available from Tsurumi Chemical Industry Co., Ltd.) | 1 part by mass |
| Vulcanization accelerator (Nocceler DM available from Ouchi Shinko Chemical Industrial Co., Ltd.) | 2.0 parts by mass |
| Vulcanization accelerator (Nocceler TT available from Ouchi Shinko Chemical Industrial Co., Ltd.) | 0.5 parts by mass |

Formation of Surface Layer

The following mixture is mixed in a bead mill to obtain a dispersion. The obtained dispersion is diluted with methanol. The diluted dispersion is applied to the surface (outer surface) of the conductive elastic layer 14B by dip coating and then dried by performing heating at 140° C. for 15 minutes. This process provides a charging roller 14 having a surface layer with a thickness of 4 μm.

| | |
|---|---|
| Polymer material (copolymer nylon, Amilan CM8000 available from Toray Industries, Inc.) | 20 parts by mass |
| Conductive agent (antimony-doped tin oxide, SN-100P available from Ishihara Sangyo Kaisha, Ltd.) | 30 parts by mass |
| Solvent (methanol) | 500 parts by mass |
| Solvent (butanol) | 240 parts by mass |

Cleaning Roller 1

A urethane foam sheet having a thickness of 2.4 mm (FHS available from Inoac Corporation) is cut into a strip having a width of 5 mm and a length of 360 mm. A double-sided tape having a thickness of 0.05 mm (No. 5605 available from Nitto Denko Corporation) is stuck to the entire surface of the cut strip to provide a strip with the double-sided tape.

The obtained strip with the double-sided tape is placed on a horizontal stage with the release liner attached to the double-sided tape downward. An end portion of the strip in the longitudinal direction is pressed from above by using heated stainless steel in such a manner that the thickness of a portion of the strip in the range of 1 mm long in the longitudinal direction from the end portion of the strip in the longitudinal direction becomes 15% of the thickness of the other portion.

The obtained strip with the double-sided tape is placed on a horizontal stage with the release liner attached to the double-sided tape upward. The strip with the double-sided tape is wound around a metal core (material=SUM24EZ, outer diameter=5.0 mm, full length=338 mm) with tension in such a manner that the helix angle θ becomes 30° and the full length of the strip elongates by 0% to 5%.

Cleaning Roller 2

A cleaning roller 2 is produced in the same manner as for the cleaning roller 1 except that a urethane foam sheet (EMM available from Inoac Corporation) is used as a urethane foam sheet.

Cleaning Roller 3

A cleaning roller 3 is produced in the same manner as for the cleaning roller 1 except that a urethane foam sheet (EP-70S available from Inoac Corporation) is used as a urethane foam sheet.

Cleaning Roller 4

A cleaning roller 4 is produced in the same manner as for the cleaning roller 1 except that a urethane foam sheet (EZQ-S available from Inoac Corporation) is used as a urethane foam sheet.

Examples 1 to 6 and Comparative Examples 1 to 4

The produced charging roller 14 is installed in a drum cartridge of an image forming apparatus "DocuCentre-V C7775 available from Fuji Xerox Co., Ltd." The cleaning roller shown in Table 1 is installed in the drum cartridge so as to be in contact with the charging roller in the state where the foamed elastic layer is deformed at the compression ratio and the amount of nipping shown in Table 1. This apparatus is used as apparatuses in Examples 1 to 6 and Comparative Examples 1 to 4.

Evaluation of Cleaning Performance

The apparatuses in Examples and Comparative Examples are subjected to the test for evaluating the cleaning performance of the cleaning roller.

In the evaluation test, an image quality pattern having 100% image density and having a strip shape 320 mm long in the output direction×30 mm wide is printed on 50,000 sheets of A3 recording paper in an environment at 32° C. and 85% RH. The cleaning performance on adhering matter is then evaluated through observation of the surface conditions of the charging roller 14 in a position in which the image quality pattern is printed. By using the same apparatus, the same image quality pattern is further printed on 50,000 sheets (printed on total 100,000 sheets) in an environment at 10° C. and 15% RH. The surface conditions are observed in the same manner to evaluate the cleaning performance on adhering matter. The cleaning performance is evaluated on the basis of the following criterion through direct observation of the surface of the charging roller with a confocal laser scanning microscope (OLS1100 available from Olympus Corporation).

Evaluation of Cleaning Performance: Criterion

G0: Adhering matter is found in the range of 10% or less per $\mu m^2$ of the surface of the charging roller.

G0.5: Adhering matter is found in the range of more than 10% and 20% or less per $\mu m^2$ of the surface of the charging roller.

G1: Adhering matter is found in the range of more than 20% and 30% or less per $\mu m^2$ of the surface of the charging roller.

G2: Adhering matter is found in the range of more than 30% and 40% or less per $\mu m^2$ of the surface of the charging roller.

G3: Adhering matter is found in the range of more than 40% and 50% or less per $\mu m^2$ of the surface of the charging roller.

TABLE 1

| | | | Example 1 | Example 2 | Example 3 | Example 4 | Comparative Example 1 | Comparative Example 2 |
|---|---|---|---|---|---|---|---|---|
| Configuration | Cleaning Roller | Cleaning Roller No. | 1 | 1 | 2 | 2 | 3 | 3 |
| | | $P_{80}$ (80% compression stress) [N] | 103 | 103 | 349 | 349 | 62 | 62 |
| | | Pw (70% compression stress) [N] | 47 | 47 | 200 | 200 | 40 | 40 |
| | | $P_{50}$ (50% compression stress) [N] | 18 | 18 | 63 | 63 | 25 | 25 |
| | | Ps (10% compression stress) [N] | 7 | 7 | 28 | 28 | 14 | 14 |
| | | Pw/Ps | 6.7 | 6.7 | 7.1 | 7.1 | 2.9 | 2.9 |
| | | $P_{50}$/Ps | 2.6 | 2.6 | 2.3 | 2.3 | 1.8 | 1.8 |
| | | $P_{80}$/Ps | 14.7 | 14.7 | 12.5 | 12.5 | 4.4 | 4.4 |
| | Compression Ratio [%] | | 15 | 30 | 15 | 30 | 15 | 30 |
| | Amount [mm] of Nipping between Charging Roller and Cleaning Roller | | 0.3 | 0.6 | 0.3 | 0.6 | 0.3 | 0.6 |
| Evaluation | Cleaning Performance (after printing on 100,000 sheets) | | G0 | G0 | G0.5 | G0.5 | G3 | G3 |

| | | | Comparative Example 3 | Comparative Example 4 | Example 5 | Example 6 |
|---|---|---|---|---|---|---|
| Configuration | Cleaning Roller | Cleaning Roller No. | 4 | 4 | 1 | 1 |
| | | $P_{80}$ (80% compression stress) [N] | 24 | 24 | 103 | 103 |
| | | Pw (70% compression stress) [N] | 12 | 12 | 47 | 47 |
| | | $P_{50}$ (50% compression stress) [N] | 6 | 6 | 18 | 18 |
| | | Ps (10% compression stress) [N] | 3 | 3 | 7 | 7 |
| | | Pw/Ps | 4.0 | 4.0 | 6.7 | 6.7 |
| | | $P_{50}$/Ps | 2.1 | 2.1 | 2.6 | 2.6 |
| | | $P_{80}$/Ps | 8.1 | 8.1 | 14.7 | 14.7 |
| | Compression Ratio [%] | | 15 | 30 | 13 | 33 |
| | Amount [mm] of Nipping between Charging Roller and Cleaning Roller | | 0.3 | 0.6 | 0.25 | 0.65 |
| Evaluation | Cleaning Performance (after printing on 100,000 sheets) | | G2 | G2 | G1 | G1 |

The above-described evaluation results reveal that Examples are superior to Comparative Examples in terms of cleaning performance (i.e., ability to maintain cleaning performance).

The foregoing description of the exemplary embodiments of the present disclosure has been provided for the purposes of illustration and description. It is not intended to be exhaustive or to limit the disclosure to the precise forms disclosed. Obviously, many modifications and variations will be apparent to practitioners skilled in the art. The embodiments were chosen and described in order to best explain the principles of the disclosure and its practical applications, thereby enabling others skilled in the art to understand the disclosure for various embodiments and with the various modifications as are suited to the particular use contemplated. It is intended that the scope of the disclosure be defined by the following claims and their equivalents.

What is claimed is:

1. A cleaning member comprising:

a shaft; and a foamed elastic layer that is disposed on an outer surface of the shaft and in which a relationship between a stress Pw generated by 70% compression deformation and a stress Ps generated by 10% compression deformation satisfies Pw/Ps≥6, wherein, in the foamed elastic layer, the relationship between a stress $P_{50}$ generated by 50% compression deformation and the stress Ps generated by 10% compression deformation satisfies $2.6 \geq P_{50}/Ps \geq 2.3$.

2. The cleaning member according to claim 1, wherein, in the foamed elastic layer, the relationship between a stress $P_{80}$ generated by 80% compression deformation and the stress Ps generated by 10% compression deformation satisfies $P_{80}/Ps \geq 12$.

3. The cleaning member according to claim 2, wherein, in the foamed elastic layer, the relationship between the stress $P_{80}$ generated by 80% compression deformation and the stress Ps generated by 10% compression deformation satisfies $P_{80}/Ps \geq 14$.

4. The cleaning member according to claim 1, wherein, in the foamed elastic layer, the relationship between a stress $P_{80}$ generated by 80% compression deformation and the stress Ps generated by 10% compression deformation satisfies $P_{80}/Ps \leq 20$.

5. The cleaning member according to claim 1, wherein the foamed elastic layer is helically wound around the shaft from one end side to the other end side of the shaft.

6. An assembly comprising:

a member to be charged;

a charging member that charges the member to be charged and rotates; and the cleaning member according to claim 1 that is driven to rotate by contact with the rotating charging member and cleans the charging member, wherein the member to be charged, the charging member, and the cleaning member are integrally attachable to and detachable from an apparatus body.

7. The assembly according to claim 6, wherein the cleaning member is in contact with the charging member while the foamed elastic layer of the cleaning member is deformed at a compression ratio of 15% or more and 30% or less.

8. The assembly according to claim 6, wherein an amount E of nipping between the charging member and the cleaning member is 0.3 mm or less.

9. An image forming apparatus comprising:

an image-caniable image carrier;

a charging member that charges the image carrier and rotates;

an exposure device that exposes the image carrier charged by the charging member and forms an electrostatic latent image;

a developing device that develops the electrostatic latent image formed on the image carrier by the exposure device; and the cleaning member according to claim 1 that is driven to rotate by contact with the rotating charging member and cleans the charging member.

10. The image forming apparatus according to claim 9, wherein the cleaning member is in contact with the charging member while the foamed elastic layer of the cleaning member is deformed at a compression ratio of 15% or more and 30% or less.

11. The image forming apparatus according to claim 9, wherein an amount E of nipping between the charging member and the cleaning member is 0.3 mm or less.

* * * * *